US007559861B2

(12) United States Patent
Yoshihara et al.

(10) Patent No.: US 7,559,861 B2
(45) Date of Patent: Jul. 14, 2009

(54) RACKET, BLADE AND RUBBER FOR TABLE TENNIS

(75) Inventors: Kiyotaka Yoshihara, 15-2, Higashichuo 2-chome, Fukushima-shi, Fukushima 960-8071 (JP); Naoko Okada, Fukushima (JP)

(73) Assignees: Adco Koki Co., Ltd., Tokyo (JP); Kiyotaka Yoshihara, Fukushima-shi (JP)

( * ) Notice: Subject to any disclaimer, the term of this patent is extended or adjusted under 35 U.S.C. 154(b) by 536 days.

(21) Appl. No.: 11/490,972

(22) Filed: Jul. 21, 2006

(65) Prior Publication Data

US 2007/0066425 A1 Mar. 22, 2007

(30) Foreign Application Priority Data

Sep. 22, 2005 (JP) ..... 2005-276485
Feb. 14, 2006 (JP) ..... 2006-036402

(51) Int. Cl.
*A63B 59/04* (2006.01)

(52) U.S. Cl. ..... 473/527; 473/529

(58) Field of Classification Search ..... 473/527–530; 428/315.5, 315.7

See application file for complete search history.

(56) References Cited

U.S. PATENT DOCUMENTS

| | | | | |
|---|---|---|---|---|
| 1,064,914 A | | 6/1913 | Jones | |
| 2,311,546 A | * | 2/1943 | Hurt | 473/529 |
| 2,328,366 A | * | 8/1943 | Timmermann | 473/529 |
| 3,689,210 A | | 9/1972 | Stein | |
| 4,318,875 A | * | 3/1982 | Shrimpton et al. | 264/54 |
| 4,324,400 A | * | 4/1982 | Tse | 473/529 |
| 5,910,528 A | | 6/1999 | Falicoff et al. | |

FOREIGN PATENT DOCUMENTS

| | | | |
|---|---|---|---|
| BE | 549 488 | | 11/1959 |
| DE | 31 07 681 | | 9/1982 |
| DE | 201 05 753 | | 8/2001 |
| DE | 100 36 477 | | 2/2002 |
| FR | 2 525 114 | | 10/1983 |
| GB | 2 030 871 | | 4/1980 |
| JP | 06240218 | A * | 8/1994 |
| JP | 08229175 | A * | 9/1996 |
| JP | 2007111497 | A * | 5/2007 |
| JP | 2008074935 | A * | 4/2008 |
| JP | 2008110145 | A * | 5/2008 |
| JP | 2008259742 | A * | 10/2008 |
| WO | WO 92/09335 | | 6/1992 |

* cited by examiner

*Primary Examiner*—Raleigh W. Chiu
(74) *Attorney, Agent, or Firm*—Flynn, Thiel, Boutell & Tanis, P.C.

(57) ABSTRACT

A table tennis racket includes a rubber (4) attached onto a blade (3) and easily removable without releasing any air-polluting gas. Opposing surfaces of the blade (3) and the rubber (4) have fine pores and lands of a micro-foam material, and the rubber (4) is removably held on the blade (3) with a vacuum suction force produced between the blade (3) and rubber (4) when pressed together.

8 Claims, 5 Drawing Sheets

RACKET, BLADE AND RUBBER FOR TABLE TENNIS

BACKGROUND OF THE INVENTION

1. Field of the Invention

The present invention generally relates to a racket, blade and rubber for table tennis.

2. Background Art

A table tennis racket includes a blade with a grip portion, and a rubber sheet (hereafter simply called a rubber as well) fixed on a rubber-receiving surface (one of major surfaces) of the blade. Rubbers are consumable supplies for athletic table-tennis players, and they are replaced and renewed in short cycles. A typical means for holding rubbers onto blades is temporary bonding by an adhesive. The most prevalent adhesives for temporary bonding contain volatile organic solvents. However, as Japanese Utility Model Laid-Open Publication, JP-H07-24360-U, mentions as well, it has been pointed out that volatile organic adhesives generate gases and pollute the environmental air every time when used rubbers are replaced with new ones. Therefore, International Table Tennis Federation decided to prohibit the use of adhesives containing organic solvents.

The industrial field of table tennis articles undertook research and development of an adhesive containing no such organic solvents and usable for temporary bonding, and actually developed an adhesive using water instead of organic solvents, for example. However, the water-based adhesive needs much time of about one hour until it dries. In addition, almost all blades of table tennis rackets used by table tennis athletes are made of wood and readily absorb the water contained in the adhesive. As a matter of course, too much moisture in blades changes their properties. Actually, it is often reported that blades degrade in property with moisture every time upon renewal of rubbers.

Double-faced adhesive films and solid adhesives are commercially available for use to hold rubbers on blades. As pointed out in the Japanese Patent Laid-Open Publication, JP-H07-67994, rubbers once fixed to blades with double-faced adhesive films are difficult to remove from the blades, and need time and labor for renewal of rubbers. Therefore, double-faced adhesive films have not come into wide use till now. Also, solid adhesives failed to become widespread because of the problem that they often leave their residue on blades after removal of rubbers.

Table tennis players cannot often acquire ideal blades that fit to their own playing styles including their own swinging and gripping forms throughout their careers as active players. Therefore, it will not be acceptable for such players that replacement of rubbers invites damage and undesirable changes in property of their favorite blades.

In addition, it often occurs that a rubber must be renewed immediately at the site of a competition. Therefore, it is important that players can change rubbers easily and quickly.

Thus, there is a need for a table tennis racket, its blade and rubber that can prevent air pollution by gas, which is a serious problem of great concern to the modern society, and can facilitate renewal of the rubber.

Further, there is a need for a table tennis racket, its blade and rubber that prevent damage to the blade upon replacement of the rubber.

Furthermore, there is a need for a table tennis racket, its blade and rubber that enable quick removal of the rubber without leaving any residue on the blade after removal of the rubber.

SUMMARY OF THE INVENTION

According to the present invention, there is provided a table tennis racket including a blade and a rubber attached to the blade, comprising: the rubber being removably held on the blade; and the rubber being fixed to the blade with a physical means that permits the rubber to be removed from the blade without leaving any residue on the blade.

There are some typical examples of the above physical means that can hold rubbers immovably and removably on blades and do not leave any residue on blades after removal of rubbers. One of them is a holding means using a suction force by vacuum or reduced pressure (hereafter referred to as "vacuum suction force" wherever appropriate). Another is a holding means using a magnetic attraction force. Another is a holding means using a kind of fastening tapes including a hook and loop fastener. Another is a holding means using engagement of projections and depressions.

There are further physical means capable of reliably holding rubbers on blades while permitting easy removal of rubbers from the blades without leaving any residue thereon. For example, temporary-bonding pressure-sensitive adhesives, which are moderate in adhesive force and used on commercially available Post-it (registered trademark) articles and residue-free adhesive tapes, can be used as well to hold rubbers on blades. The term "residue-free" is herein used to say that an adhesive can be removed without leaving residue on the adherend. In the case where this type of adhesive is used to hold a rubber on a blade, the rubber should preferably have a bottom layer of the pressure-sensitive adhesive. Alternatively, the rubber should preferably include a film coated by a pressure-sensitive adhesive and attached to the bottom surface of the rubber. A user may purchase a rubber having the pressure-sensitive adhesive layer, and can fix the rubber to a blade by simply pressing the rubber onto the blade. In this process, no gas is released from the adhesive. As a matter of course, it is recommended to establish a supply system for supplying table tennis blades prepared to receive and hold rubbers coated with such pressure-sensitive adhesives. Blades of this type should preferably have, for example, a smooth film or coating on a major surface thereof used as a rubber-receiving surface. Thus, a user can readily clean the rubber-receiving surface of a blade by wiping it with a towel or the like before attaching a fresh rubber having a coating of a pressure-sensitive adhesive.

In case a vacuum suction force is used to hold rubbers on blades, the vacuum suction force can be produced by joining two surfaces each having numerous minute pores and lands. Alternatively, the same purpose can be attained by joining two smooth surfaces or, more preferably, two highly smooth surfaces, or joining a surface having numerous minute pores and lands to a smooth surface. Smooth surfaces can be made by bonding smooth plastic films on rubber-receiving surfaces of blades and/or on mount surfaces of rubbers, or by coating rubber-receiving surfaces of blades or mount surfaces of rubbers with lacquer, for example. Surfaces having numerous minute pores and lands can be made by bonding elastic materials having a lot of minute pores onto rubber-receiving surfaces of blades or mount surfaces of rubbers, for example.

In case a magnetic attraction force is used to hold rubbers on blades, a surface of a rubber or a blade, which contains a magnetic substance such as magnetic powder, may be combined with a surface of the other of the rubber and the blade, which contains a substance attracted by a magnetic force such as metallic powder. Thus, the rubber and the blade are drawn together by a magnetic attraction force produced between their surfaces.

A typical example of fastening tapes is a hook and loop fastener, such as Velcro (trademark), consisting of two opposing pieces of fabric, one with a dense arrangement of tiny hooks for example of nylon and the other with a dense pile for example of nylon, that interlock when pressed together.

A typical example of projection-and-depression engagement means is a combination of two molded plates, each having an arrangement of alternate projections and depressions. These two molded plates may be either identical or different in shapes of projections and depressions. It is sufficient that projections on one plate and depressions in the other plate are approximately complementary. One of the molded plates may be bonded to a blade, and the other may be bonded to a rubber.

As such, according to embodiments of the present invention, the racket can retain the rubber on the blade with a physical or mechanical force such as vacuum suction, magnetic attraction, mechanical interlocking, engagement between projections and depressions, and adhesion of pressure-sensitive residue-free adhesives. Therefore, when a user need to replace the rubber, he/she can remove the used rubber from the blade by simply stripping the rubber from the blade with a pulling force exceeding the rubber-retaining force, and he/she need not use any organic solvent to recover the approximately original surface condition of the blade, for example, without residue of an adhesive, which will disturb good attachment of a fresh rubber. Thus, replacement of rubbers can be finished in a short time.

The foregoing and other features, aspects and advantages of the present invention will become apparent from the detailed description of the preferred embodiments of the invention given below in conjunction with the accompanying drawings.

DETAILED DESCRIPTION OF THE INVENTION

Figure 1:
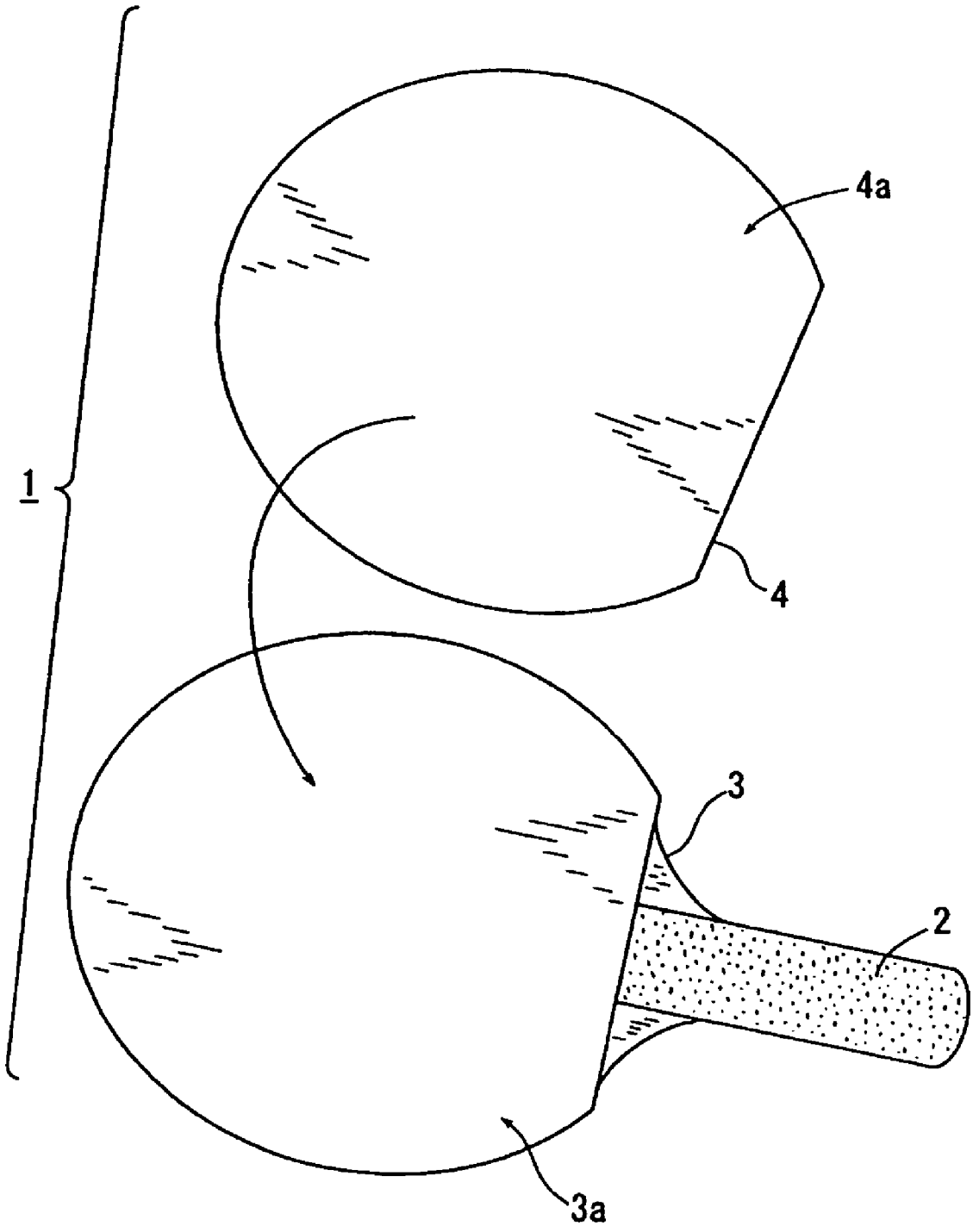
FIG. 1 is an exploded view of a table tennis racket according to an embodiment of the present invention in which a rubber should be held on a blade by a suction force derived from a vacuum or reduced pressure produced between the rubber and the blade when pressed together.
Figure 2:
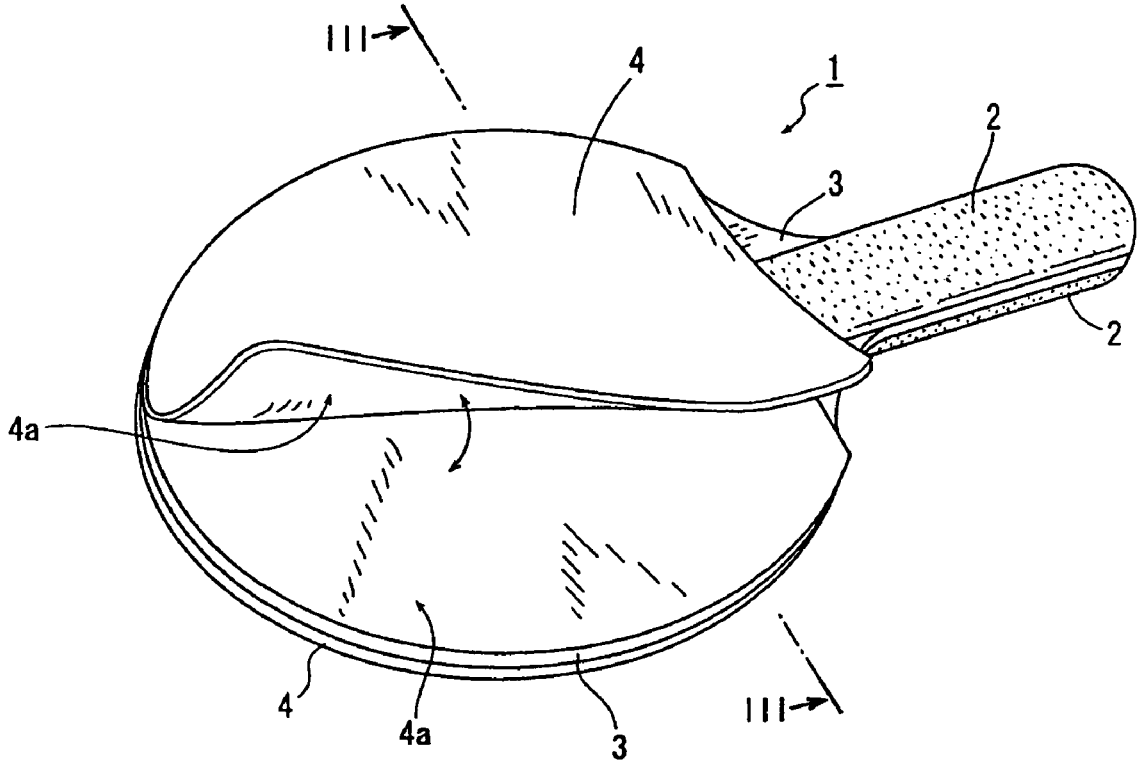
FIG. 2 shows the racket in FIG. 1, with the rubber being partially stripped from the blade.
Figure 3:
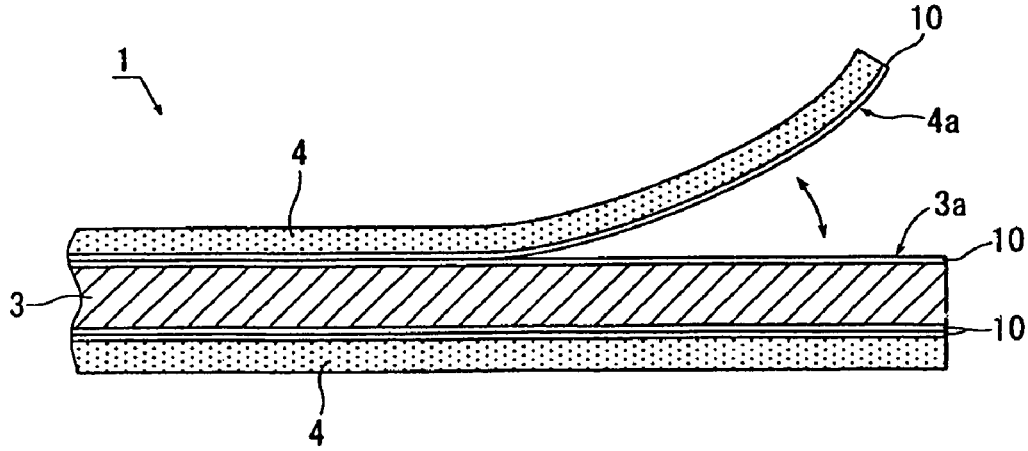
FIG. 3 is a cross-sectional view of the racket, taken along the III-III line of FIG. 2.

Currently preferred embodiments of the present invention are described below in detail with reference to the accompanying drawings. Referring now to FIG. 1, a table tennis racket according to an embodiment of the present invention is schematically illustrated in an exploded view. As shown, the racket, generally indicated with a reference numeral 1, includes a blade 3 with a grip portion 2, and a rubber 4 removably held on a rubber-receiving surface 3*a* of the blade 3.

The rubber 4 is attached to one or both of major surfaces of the blade, which are often called rubber-receiving surfaces 3*a* hereafter. There are single-side rubber rackets having one rubber on only one surface of the blade and double-side rubber rackets having two rubbers on both sides of the blade. Players may choose a single-side rubber racket or a double-side rubber racket, depending upon their play styles. Further, there are soft-type rubbers and hard-type rubbers that are different in hardness. Players may choose a soft-type rubber or a hard-type rubber according to their own tastes or play styles.

The basic structure of the blade 3 may be selected from conventional structures. A typical structure of the blade 3 is a lamination of thin wooden plates, but a single wooden plate may be used to form the blade as well. The rubber-receiving surface 3*a* of the blade 3 for retaining the rubber 4 has a structure that can function as an attractive surface. The attractive surface of the blade 3 shown here is made of an elastic member having numerous fine pores and lands on its surface as explained later in greater detail.

The rubber 4 includes a known structure that is typically a lamination of a sponge layer and a rubber layer. The bottom surface of the rubber 4, which is brought into contact with the blade 3, has a structure of, and functions as, a counterpart attractive surface 4*a* as explained later in greater detail.

As mentioned above, the blade 3 and the rubber 4 have the attractive surfaces 3*a* and 4*a* respectively. Thus, the rubber 4 is retained on the blade 3 physically by a vacuum suction force produced between the attractive surfaces 3*a*, 4*a* when pressed together. Therefore, when a user wants to replace a used rubber with a fresh one, he or she may strip the rubber 4 from the blade 3 with a pulling force greater than the vacuum suction force between the rubber 4 and the blade 3, and can easily remove the rubber 4 without leaving undesirable residue on the blade 3. After removing the rubber 4, the user may put a fresh rubber 4 in position on the blade 3 and may slightly press it onto the blade 3. With this simple operation, the player can complete a table tennis racket 1 having the fresh rubber 4 reliably held on the blade 3. Since this embodiment uses no conventional adhesive, it does not occur that an inorganic solvent vaporizes and releases an undesirable gas, which was an inevitable problem with conventional rackets during renewal of rubbers on blades. Therefore, the racket 1 according to embodiments of the invention has no possibility of air pollution.

Both of the attractive surface 3*a* of the blade 3 and the attractive surface 4*a* of the rubber 4 may be smooth surfaces as well. One of the attractive surfaces 3*a* and 4*a* may be configured as a counter attractive surface. Such a counter attractive surface may be made by bonding a plastic film exhibiting a high surface smoothness such as polypropylene (PP) or polyester. Alternatively, the counter attractive surface can be made by coating the blade 3 or rubber 4 with a lacquer or a plastic material of a compact structure, or by coating the blade 3 or rubber 4 with a two-component polyurethane resin paint, for example, which is easy to polish and contains no organic solvent such as toluene, and thereafter hardening and polishing the paint.

Figure 4:
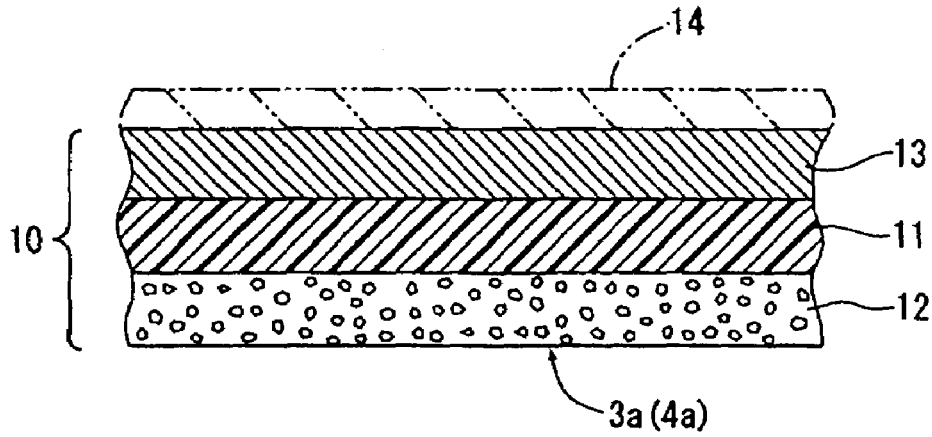
FIG. 4 shows a cross-sectional structure of an elastic sheet that can be used in an embodiment of the present invention.

FIG. 4 shows a multi-layered elastic sheet 10 having a surface with numerous fine pores and lands suitable to make the attractive surfaces 3*a* and/or 4*a* of the blade 3 and/or rubber 4. As shown in FIG. 4, the elastic sheet 10 includes a thin base layer 11 such as a polypropylene (PP) film, polyethylene terephthalate (PET) film or polyester film. The elastic sheet 10 further includes a repulsive layer 12 bonded to one surface of the base layer 11, and an adhesive layer 13 of an acrylic resin adhesive such as acrylic copolymer resin adhesive bonded to the opposite surface of the base layer 11. In embodiments of the present invention, the repulsive layer 12 is made of a micro-foam material containing an acrylic resin such as acrylic ester copolymer resin, carbon and pigment. The surface of the micro-foam material exhibits an attractive or suction force produced by a vacuum or reduced pressure in the fine pores of the micro-foam material, which partially loses air and make a reduced pressure therein when pressed and closed airtightly.

Figure 5:
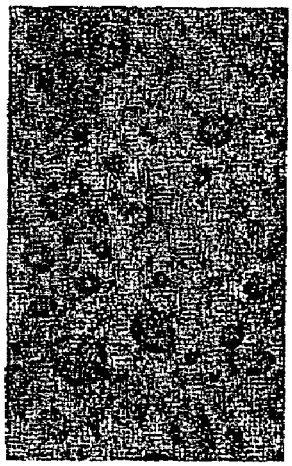
FIG. 5 is a micrograph of a surface portion of a micro-foam material containing acrylic ester copolymer resin as its major component.

FIG. 5 shows a 320-magnification micrograph of a surface portion of the micro-foam material used as the repulsive layer 12 of the elastic sheet 10 in this embodiment. The mean depth of the fine pores appearing on the surface of the micro-foam material was about 11 μm.

The elastic sheet 10 in FIG. 4 is cut along the contour of the blade 3 and/or rubber 4 for actual use. Until the elastic sheet 10 is actually used on the blade 3 or rubber 4, the adhesive layer 13 of the elastic sheet 10 is preferably kept covered with a release film 14.

When the elastic sheet 10 is bonded to the blade 3 and/or rubber 4, it is recommended to press them together while heating them. Thus, the elastic sheet 10 can be united to the blade 3 and/or rubber 4 so tight that it reliably keeps integrality with the blade 3 or rubber 4 and does not remain alone on the counterpart rubber 4 or blade 3 when the rubber 4 is removed from the blade 3 for renewal.

In case the attractive surface 3*a* is prepared on the blade 3 by bonding the elastic sheet 10 on the blade 3, the elastic sheet 10 had better be removable from the blade 3 for renewal when the attractive force of the attractive layer 3*a* or the repulsive force of the repulsive layer 12 decreases. For this purpose, the adhesive layer 13 is preferably made of a removable-type adhesive rather than a permanent-type adhesive. That is, the adhesive layer 13 is preferably made of an adhesive that damages the blade 3 little or leaves little residue on the blade 3 when the elastic sheet 10 is removed from the blade 3. For example, one of the currently most popular adhesives containing organic solvents may be used for this purpose. Even if a rubber-family adhesive containing this organic adhesive is used, it does not occur so often that users must change the elastic sheet 10 for themselves, and the problem of pollution by vaporization of gases from the organic solvents seldom occurs. In most cases, only manufacturers will treat rubber-family adhesives containing organic solvents in the process of manufacturing the blades 3 and rubbers 4 under controls against vaporization of gases from the organic solvents. Therefore, it will be an extremely rare case that gymnasiums or other sites of table tennis competitions are involved by or spread environmental pollution. As a matter of course, the elastic sheet 10 may be fixed to the blade 3 with a water adhesive containing no organic solvent for more strict preclusion of such pollution.

The elastic sheet 10 including the micro-foam material having fine pores and lands on the surface thereof can be used on all types of currently available or producible blades 3 and rubbers 4 to alter them to be drawn and held together by a vacuum suction force. At the same time, the repulsive layer 12 alleviates the problem with conventional table tennis rackets caused by the existence of the base layer 11 between the blade 3 and the rubber 4, i.e. deterioration of the force for bouncing the ball. The Inventors actually examined a racket whose repulsive layer 12 is made of a micro-foam material containing the above-mentioned acrylic ester copolymer resin as its major component, and could confirm that the blade 3 exhibited substantially the same repulsive force as those of the currently most popular table tennis rackets using adhesives containing organic solvents.

Removable fixture of the rubber 4 to the blade 3 with the vacuum attractive force can be accomplished as well by fixing the elastic sheet 10 to the blade 3 or rubber 4 while preparing a smooth surface on the counterpart rubber 4 or blade 3 by bonding a highly smooth and compact plastic film such as PP, PET or polyester film or coating it with a highly smooth coating material (such as a coating material containing glass fibers or glass powder). In this case, a desirable ball-bouncing force of the racket can be attained by increasing the thickness of the repulsive layer 12 of the elastic sheet 10 or adjusting the repulsive performance of the rubber 4, for example.

Figure 6:
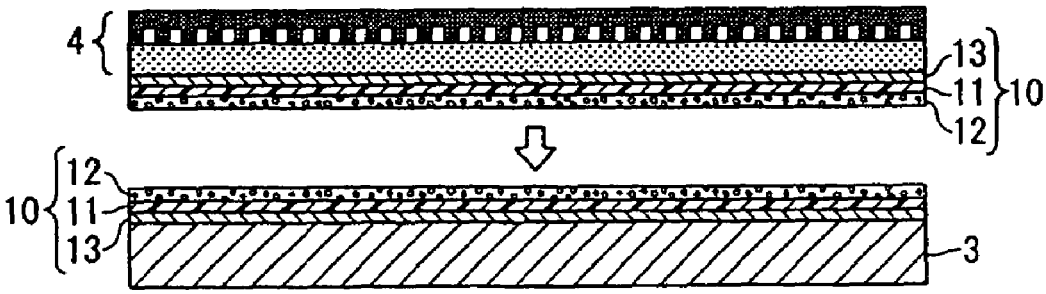
FIG. 6 is a diagram schematically illustrating a combination of a sheet of micro-foam elastic material bonded to a bonding surface of the rubber and a sheet of micro-foam material bonded to a rubber-receiving surface of the blade, which can draw the rubber and the blade together with a suction force of a vacuum or reduced pressure produced between fine pores and lands of the micro-foam elastic material sheets when pressed together.

Heretofore, various embodiments of the present invention have been explained. In short, in the first embodiment, as shown in FIG. 6, the elastic sheet 10 is attached to both the blade 3 and the rubber 4 to provide surfaces having fine pores and lands on both the blade 3 and rubber 4. Thereby, when such surfaces of the blade 3 and the rubber 4 are put and pressed together, the pores of both surfaces are evacuated and closed by the lands of the counterpart surfaces. Thus, the vacuum or reduced pressure in the closed pores produces a vacuum suction force and attracts the blade 3 and the rubber 4 to each other.

Figure 7:
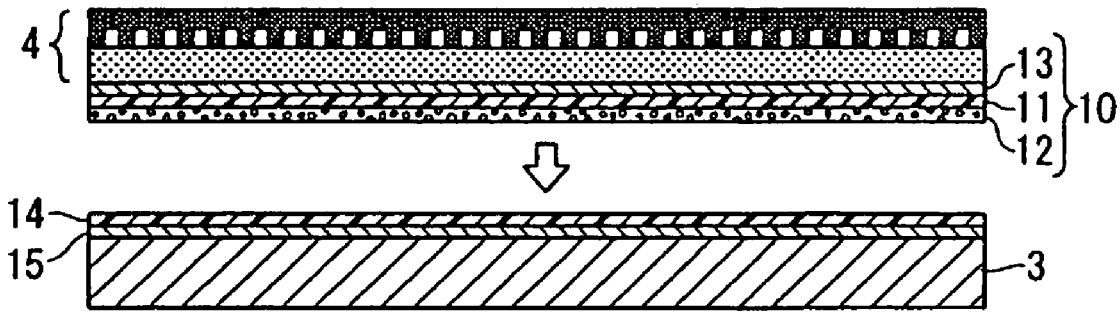
FIG. 7 is a diagram schematically illustrating a combination of a sheet of micro-foam elastic material bonded to a bonding surface of the rubber and a smooth film on the rubber-receiving surface of the blade, which can draw the rubber and the blade together with a suction force of a vacuum or reduced pressure produced between fine pores in the micro-foam elastic material sheet and the smooth film when pressed together.

In the second embodiment as shown in FIG. 7, the elastic sheet 10 is bonded to one of the blade 3 and rubber 4 to provide a surface having fine pores and lands whereas a highly smooth film 14 is bonded to the counterpart rubber 4 or blade 3 with an adhesive 15 to prepare a smooth surface. Thereby, when such surfaces of the blade 3 and the rubber 4 are put and pressed together, the pores in one of the surfaces are evacuated and closed by the counterpart smooth surface. Thus, the vacuum or reduced pressure in the closed pores produces a vacuum suction force and attracts the blade 3 and the rubber 4 to each other. Although FIG. 7 shows the elastic sheet 10 on the rubber 4 and the set of the smooth film 14 and adhesive 15 on the blade, it will be easily understood that elastic sheet 10 may be provided on the blade 3 and the set of the smooth film 14 and adhesive 15 may be provided on the rubber 4.

Figure 8:
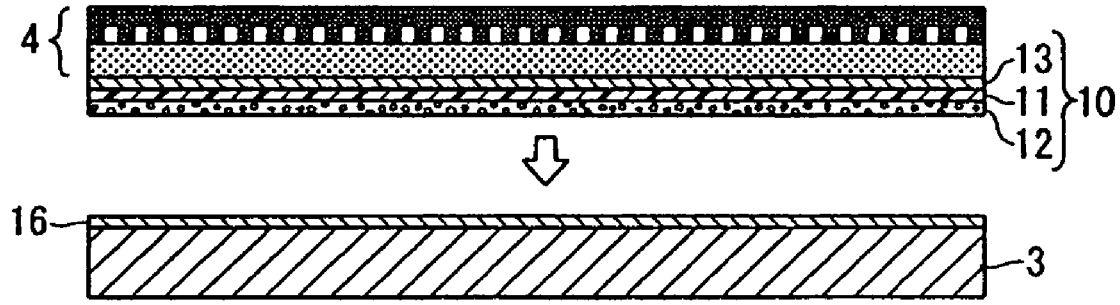
FIG. 8 is a diagram schematically illustrating a combination of a sheet of micro-foam elastic material bonded to a bonding surface of the rubber and a smooth coating on the rubber-receiving surface of the blade, which can draw the rubber and the blade together with a suction force of a vacuum or reduced pressure produced between fine pores in the micro-foam elastic material sheet and the smooth coated layer when pressed together.

In the third embodiment as shown in FIG. 8, the elastic sheet 10 is attached to one of the blade 3 and rubber 4 to prepare a surface having fine pores and lands whereas a highly smooth coating 16 is formed on the counterpart rubber 4 or blade 3. A typical coating usable as the highly smooth coating 16 is a lacquer such as a resinous varnish obtained from Japanese lacquer trees, for example. Although FIG. 8 shows the elastic sheet 10 on the rubber 4 and the smooth coating 16 on the blade 3, it will be apparent that the elastic sheet 10 may be provided on the blade and the coating 16 may be provided on the rubber 4.

Figure 9:
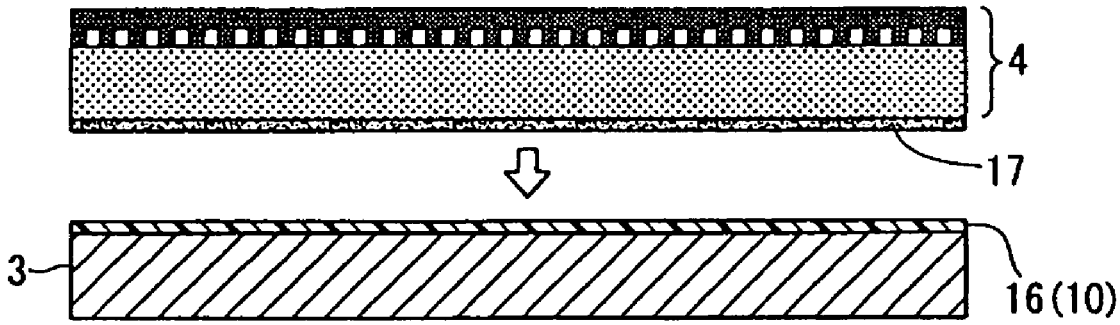
FIG. 9 is a diagram schematically illustrating a combination of a smooth surface formed by spray coating on the bonding surface of the rubber and a smooth film (or the sheet of elastic material having fine pores and lands), which can draw the rubber and the blade together with a suction force of a vacuum or reduced pressure produced between those two surfaces.

In the fourth embodiment as shown in FIG. 9, a spray-paint layer 17 is formed on one of the blade 3 and rubber 4 whereas the elastic sheet 10 (or film 14) is bonded to the counterpart rubber 4 or blade 3. Although FIG. 9 shows the spray-paint layer 17 on the rubber 4 and the smooth film 14 or the elastic sheet 10 on the blade 3, the spray-paint layer 17 may be provided on the blade 3, and the smooth film 14 or the elastic sheet 10 may be provided on the rubber 4.

Figure 10:
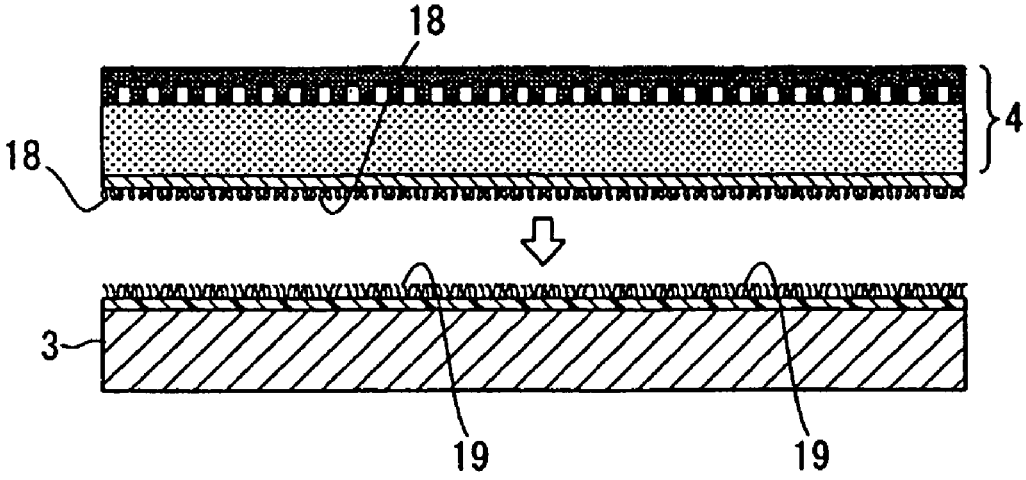
FIG. 10 is a diagram schematically illustrating a combination of two opposing fastening tapes bonded to the rubber and blade respectively, which have tiny projections and can interlock with each other to hold the rubber and the blade together.

FIG. 10 shows a fifth embodiment of the present invention in which the blade 3 and rubber 4 are fixed together with a hook-and-loop fastener as one of fastening tapes. Various types of fastening tapes are already known. The fastening tapes used in the fifth embodiment comprise opposing pieces of fabric, one with a dense arrangement of tiny hooks for example of nylon and the other with a dense pile for example of nylon, that interlock when pressed together, such as Velcro (trademark). The fabric with tiny hooks 19 is bonded to one of the blade 3 and rubber 4 whereas the fabric with the dense pile 18 is bonded to the counterpart rubber 4 or blade 3. Thus, the rubber 4 can be removably held on the blade 3 by interlocking engagement between the hooks 19 and the pile 18. Although FIG. 10 shows the pile 18 on the rubber 4 and the hooks 19 on the blade 3, the pile 18 and the hooks 19 may be provided vice versa.

Figure 11:
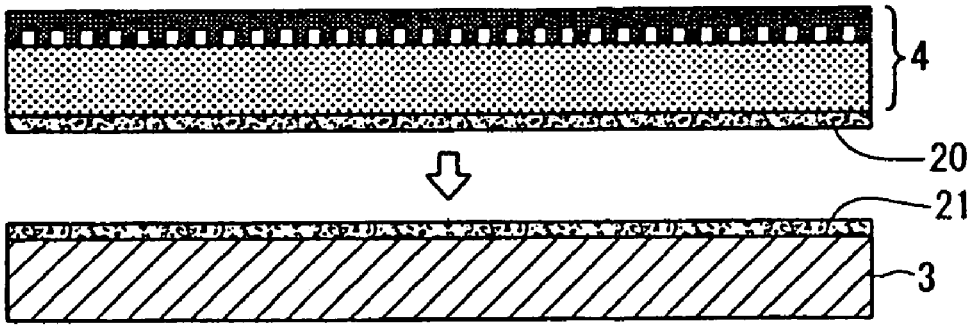
FIG. 11 is a diagram schematically illustrating a combination of a magnetic layer provided on the bonding surface of the rubber and an attractive layer containing for example metallic powder provided on the rubber-receiving surface of the blade, which can hold the rubber and the blade together with a magnetic attraction force.

FIG. 11 illustrates a sixth embodiment of the present invention in which the blade 3 and rubber 4 are drawn together by a magnetic attraction force. In this embodiment, a magnetic layer 20 including a magnetic substance is provided on one of the blade 3 and rubber 4 whereas a magnetically attracted layer 21 including metal powder or the like is provided on the counterpart rubber 4 or blade 3. Thus, the rubber 4 can be removably held on the blade 3 with the magnetic attraction force. The magnetic layer 20 may be formed by spraying a paint (or coating material) containing magnetic powder to the blade 3 or rubber 4. Alternatively, a film including the magnetic layer 20 may be bonded to the blade 3 or rubber 4. Similarly, the magnetically attracted layer 21 may be formed by spraying a paint (or coating material) containing, for example, powder of a magnetically attracted substance such as iron, to the counterpart rubber 4 or blade 3. Otherwise, it may be formed by attaching a film containing the magnetically attracted layer 21 to the rubber 4 or blade 3. Although FIG. 11 shows the version with the magnetic layer 20 on the rubber and the magnetically attracted layer 21 on the blade 3, the layers 20 and 21 may be provided vice versa.

Figure 12:
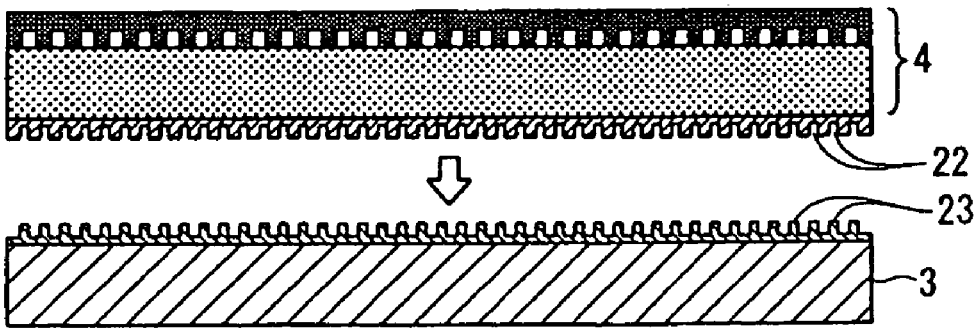
FIG. 12 is a diagram schematically illustrating a combination of arrangements of projections and depressions that can hold the rubber and the blade together when brought into engagement.

FIG. 12 illustrates a seventh embodiment in which the blade 3 has an arrangement of depressions 22 on one surface thereof, and the rubber 4 has an arrangement of projections 23 on one surface thereof. The depressions 22 and the projections 23 are preferably complementary in shape to assure tight engagement between them. Both the projections 23 and the depressions 22 may be prepared on the rubber 4 and the blade 3 by bonding a molded plate having an alternative arrangement of flexible depressions and projections on the surface of the rubber 4 and the blade 3. If each projection and each depression of the plate are complementary in shape, identical plates may be bonded to the rubber 4 and the blade 3 respectively to use the projections on the blade 3 or rubber 4 as the projections 23 while using the depressions on the counterpart rubber 4 or blade 3 as the depressions 22 that receive the projections 23 therein. Thus, the projections 23 on the blade 3 and the depressions 22 on the rubber 4 mechanically engage with each other to hold the rubber 4 on the blade 3 when put and pressed together.

Heretofore, embodiments have been explained with reference to the drawings. Although not shown, however, pressure-sensitive adhesives as used on individual sheets of commercially available notepads, such as Post-it (registered trademark) articles, or on residue-free adhesive tapes may be used as well to removably hold the rubber 4 on the blade 3. It is widely known that such notepad sheets and residue-free adhesive tapes stick to smooth surfaces and can be repositioned easily without leaving any residue of the adhesive. When the rubber 4 is fixed to the blade 3 with such a pressure-sensitive adhesive, the rubber 4 can be easily removed from the blade 3 without leaving no residue of the adhesive on the blade 3. In this case, it is recommended to prepare a layer of a pressure-sensitive adhesive on the rubber 4 and prepare a smooth surface on the blade 3 by coating the rubber-receiving surface thereof or by bonding a smooth film thereon. The smooth rubber-receiving surface prepared on the blade 3 can be easily cleaned by wiping it with a dry piece of cloth before attaching a fresh rubber 4 with a pressure-sensitive adhesive layer on the blade 3. By smoothing the rubber-receiving surface of the blade 3 in this way, it will be easier to clean the rubber-receiving surface by wiping the surface with a dry cloth, for example, before attaching a fresh rubber 4 having the pressure-sensitive adhesive applied thereon to the blade 3.

Various embodiments have been explained above with or without reference to the drawings. The present invention, however, is not limited to those embodiments, but it contemplates various changes and modifications within the concept of the present invention. Especially, one means explained as being prepared on the blade and the counterpart means explained as being prepared on the rubber may be prepared vice versa wherever appropriate in view of the natures of such means, blade and rubber.

What is claimed is:

1. A table tennis racket including a blade and a rubber attached to the blade, characterized in that:

the rubber includes a bottom surface for contact with the blade, said bottom surface being composed of a porous surface of a first micro-foam material having numerous fine pores and lands, the blade includes at least one major surface for contact with the rubber, said major surface being composed of one of a smooth surface and a porous surface of a second micro-foam material having numerous fine pores and lands, and the rubber is removably held on said major surface of the blade by a vacuum suction force produced between the bottom surface thereof and said major surface of the blade by pressing the rubber onto the blade to evacuate the numerous fine pores.

2. The table tennis racket according to claim 1 wherein the major surface of the blade is the smooth surface and is made of a film or a coating.

3. The table tennis racket according to claim 1 wherein the major surface of the blade is the porous surface of the second micro-foam material having numerous fine pores and lands.

4. A table tennis racket including a blade and a rubber attached to the blade, characterized in that:

the rubber includes a bottom surface for contact with the blade, said bottom surface being composed of a smooth surface of a film or a coating, the blade includes at least one major surface for contact with the rubber, said major surface being composed of a porous surface of a micro-foam material having numerous fine pores and lands, and the rubber is removably held on said major surface of the blade by a vacuum suction force produced between the bottom surface thereof and said major surface of the blade by pressing the rubber onto the blade to evacuate the numerous fine pores.

5. A rubber for a table tennis racket characterized in that:

a bottom surface thereof for contact with a major surface of a blade of the table tennis racket is a porous surface of a first micro-foam material having numerous fine pores and lands, and the rubber can be removably held on the major surface of the blade, which is a smooth surface or a porous surface of a second micro-foam material having numerous fine pores and lands, by a vacuum suction force produced between the bottom surface of the rubber and the major surface of the blade by pressing the rubber onto the blade to evacuate the fine pores of the micro-foam material.

6. A blade for a table tennis racket for repetitive use in combination with a replaceable rubber removably attached thereon, said rubber having a bottom surface that is a porous surface of a first micro-foam material having numerous fine pores and lands, characterized in that:

the blade has at least one major surface for contact with the bottom surface of the rubber, the major surface of the blade is a smooth surface or a porous surface of a second micro-foam material having numerous fine pores and lands, and the blade can removably hold the rubber thereon with a vacuum suction force produced between the major surface thereof and the bottom surface of the rubber by pressing the rubber onto the blade to evacuate the fine pores.

7. The blade for a table tennis racket according to claim 6 wherein the major surface of the blade is the smooth surface and is made of a film or a coating.

8. The blade for a table tennis racket according to claim 6 wherein the major surface of the blade is the porous surface of the second micro-foam material having numerous fine pores and lands.

* * * * *